United States Patent [19]

Strelnieks

[11] Patent Number: 4,878,532

[45] Date of Patent: Nov. 7, 1989

[54] FLEXIBLE DECORATIVE INTERIOR SCREEN

[76] Inventor: John Strelnieks, 3850 Wind Drift Dr., Apt. 2C, Indianapolis, Ind. 46254

[21] Appl. No.: 167,773

[22] Filed: Mar. 14, 1988

[51] Int. Cl.[4] ..... A47H 1/00

[52] U.S. Cl. ..... 160/332; 160/184

[58] Field of Search ..... 160/332, DIG. 8, 184; 441/133, 134, 44

[56] References Cited

U.S. PATENT DOCUMENTS

| | | |
|---|---|---|
| 324,519 | 8/1885 | Bates . |
| 510,590 | 12/1893 | Dreyfus . |
| 534,828 | 2/1895 | Henset . |
| 795,972 | 8/1905 | Harding . |
| 903,612 | 11/1908 | Smith . |
| 1,782,339 | 11/1930 | Campobasso . |
| 1,835,644 | 12/1931 | Grassi . |
| 2,255,714 | 9/1941 | Rodelli . |
| 2,884,054 | 4/1959 | Bryant . |
| 3,226,285 | 12/1965 | Iovenko . |
| 3,368,304 | 2/1968 | Ball . |
| 3,977,458 | 8/1976 | Kuen . |
| 4,719,957 | 1/1988 | Strelnieks . |

FOREIGN PATENT DOCUMENTS

| | | | |
|---|---|---|---|
| 2381 | 5/1883 | United Kingdom | 441/133 |
| 2054712 | 2/1981 | United Kingdom . | |

*Primary Examiner*—Blair M. Johnson

*Attorney, Agent, or Firm*—Woodard, Emhardt, Naughton, Moriarty & McNett

[57] ABSTRACT

A flexible screen closing an interior wall opening in a building, has a series of hanging columns made of adjacent tubes of flexible material, each tube having discrete pieces of solid filler material arranged in series along the length of the tube, and each tube having rings around the exterior thereof at spaced locations along the length of the tube, to constrict the tube at those locations so that the tube is sufficiently flexible to permit movement of people through the screen for passage from one room to another.

20 Claims, 3 Drawing Sheets

FLEXIBLE DECORATIVE INTERIOR SCREEN

BACKGROUND OF THE INVENTION

1. Field of the Invention

This invention relates generally to portieres, and more particularly to a new construction for them.

Many devices are used for door or window openings in a building for producing a type of screening effect or decorative effect. Examples are U.S. patents as follows:

| U.S. Pat. No. | Inventor | Issue Date |
|---|---|---|
| 324,519 | Bates | 8/18/1885 |
| 510,590 | Dreyfus | 12/12/1893 |
| 534,828 | Hensel | 2/26/1895 |
| 795,972 | Harding | 8/01/1905 |
| 903,612 | Smith | 11/10/1908 |
| 1,782,339 | Campobasso | 11/18/1930 |
| 1,835,644 | Grassi | 12/08/1931 |
| 2,255,714 | Rodelli | 9/09/1941 |
| 2,884,054 | Bryant | 4/28/1959 |
| 3,977,458 | Kuen | 8/31/1976 |

There is a U.K. Patent Application No. GB 2 054 712A which shows a suspension means for a strip door of an industrial type.

In addition to the foregoing, there is U.S. Pat. No. 3,226,285 to Iovenko disclosing in FIG. 14, strands of plastic tubing for a curtain or portiere and in which each strand has a series of alternating flat sections and sections filled with fluids, all arranged to provide a curtain or portiere. Also, there is U.S. Pat. No. 3,368,304 issued to Ball and which shows a plurality of vertically hanging flexible strips in the form of tubing knotted at the top and weighted with ball-like elements at the bottom.

Also, it is known to use overlapping transparent plastic strips hanging from a support and located to serve as the front wall of refrigerated product display cabinets or cases, as in some grocery stores.

My prior U.S. Pat. No. 4,719,957, issued Jan. 19, 1988 discloses an improvement in partitioning apparatus which is changeable from partial screening to full screening function. There has remained a need for a flexible screen susceptible to low-cost manufacture, but which is both useful and decorative and presents a different appearance from any prior art screens of which I am aware.

SUMMARY OF THE INVENTION

Described briefly, according to a typical embodiment of the present invention, the flexible screen has a series of hanging columns made of tubes of flexible material, each tube having discrete pieces of filler material arranged in series along the length of the tube, and each tube having rings at spaced locations around the exterior thereof between the pieces of filler material to constrict the tube at those locations.

DESCRIPTION OF THE PREFERRED EMBODIMENT

Figure 1:
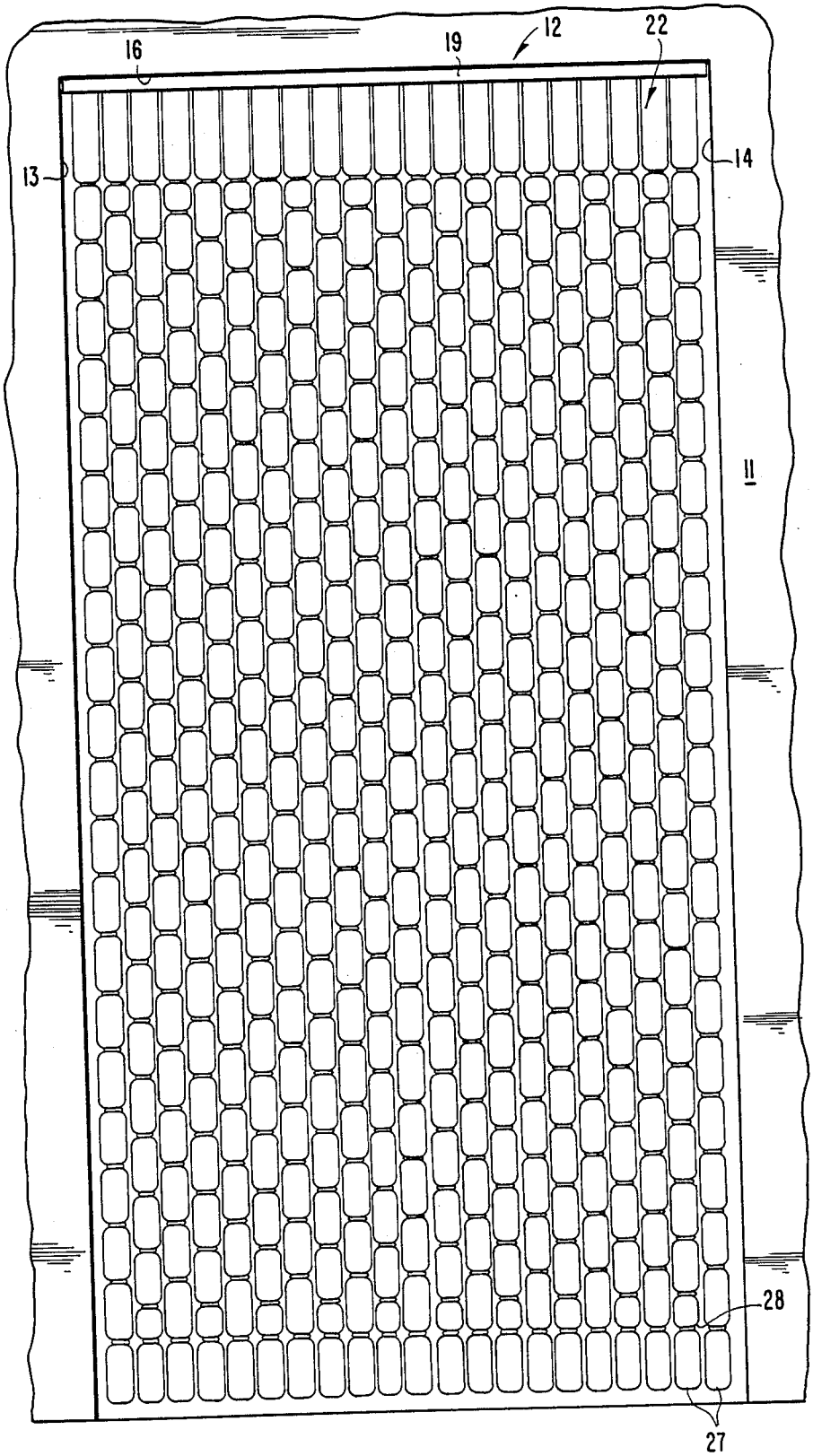
FIG. 1 is a front view of a doorway in a wall, with a typical embodiment of flexible screen of the present invention closing the doorway.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
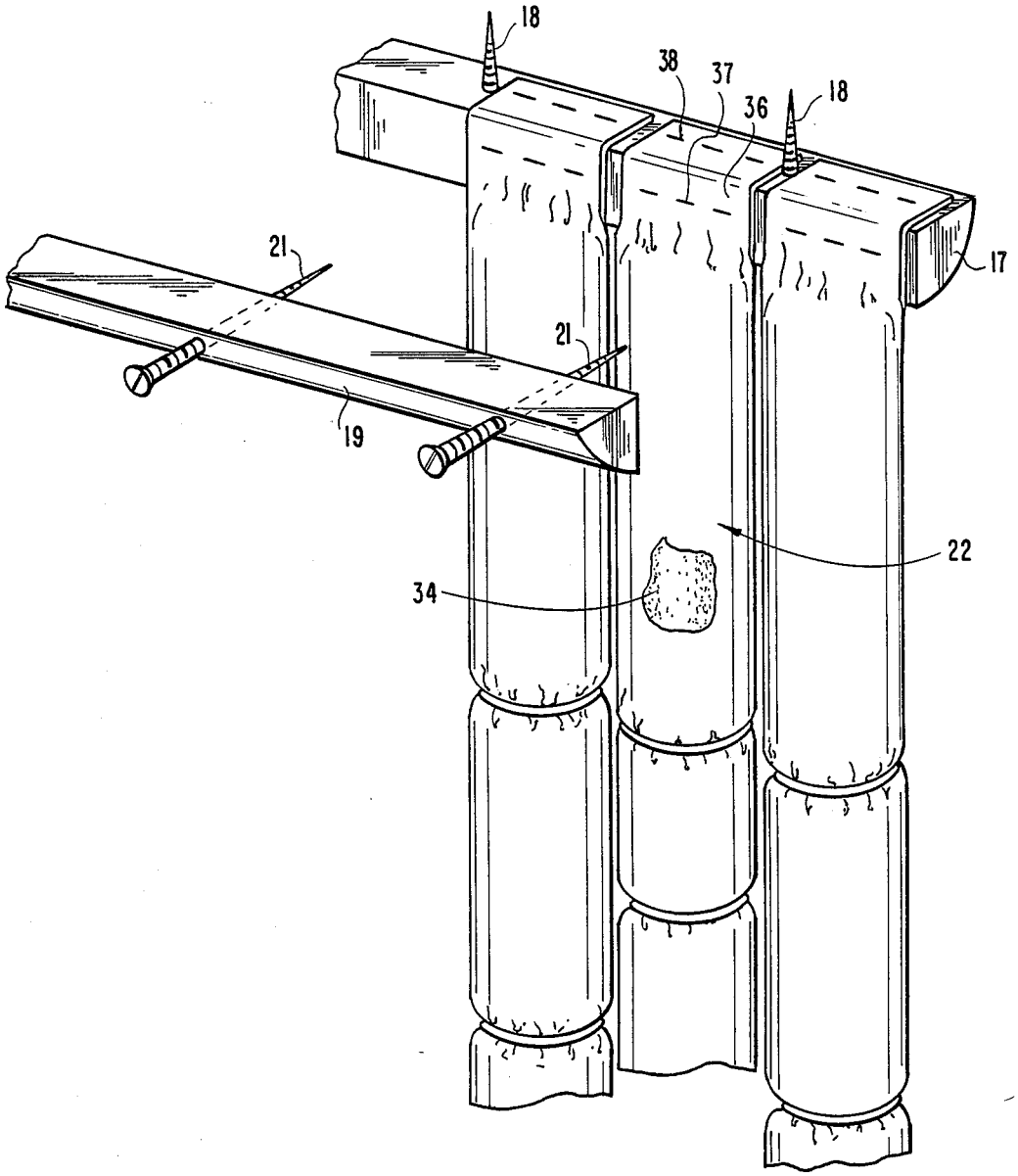
FIG. 2 is an enlarged pictorial view of a portion of the screen.

Referring now to the drawings in detail, a stationary wall 11 in a building has a doorway 12 therein which includes the door jambs 13 and 14 at the left and right-hand sides of the doorway and the header 16 at the top. The screen of the present invention is hung in the doorway by means of hanger bar 17 (FIG. 2) which is secured in the header by wood screws 18 driven into the header 16. The bar 17 may be quarter-round material as shown, or may be other decorative shapes, as desired. An identical piece 19 is mounted at the front of the piece 17, and may be screwed into the hanger bar 17 by screws 21.

The columns comprising the screens are made of individual tubes, typically of fabric. Velvet is an example. More specifically, for column 22, it is made of a velvet fabric which is initially a very long strip, the length being determined by the overall height of the screen to be used to close the doorway. 7.5 feet is an example. With the fabric inside out, the longitudinal edge portions adjacent edges 23 and 24 (FIG. 5) are stitched together. Then one end is stitched together. Then the tube is turned inside out as by placing a suitable rod (broomstick, for example) against the stitched end and pushing it through the material so as to turn it inside out. Then filler blocks are inserted. For example, the filler block 26 is inserted at the open end of the tube and pushed down to the bottom 27. Then a constricter or garter is installed at 28. In this example, the garter is a brass ring 29. This can be a solid ring slipped along the collapsed tube from the open end to a point at the top of the filler block 26. Alternatively, it could be a split ring clamped around the tube material 23 at 28, until the ends of the ring abut each other.

Then a second filler block 31 is installed in the same manner as the first until it stops at the constriction 28 where the garter ring is located. Then another garter ring 32 is installed. Then another block 33 is installed. This process is continued until the tube is essentially full when the last filler block 34 (FIG. 2) is installed near the top of the tube. At the top of this block, the tube material 23 is flattened at 36 and may be stapled to the hanger bar 17 as at 37. Additional stapling or nailing may be done for the portion of the tube that is folded over the top of bar 17 at 38. This provides additional security in the hanging of the tube on the hanger bar 17. The successive columns in the series along the length of the hanger bar can be made in the same way.

Figure 5:
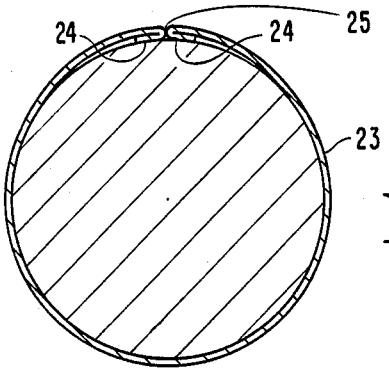
FIG. 5 illustrates a typical cross section as at line 5—5 in FIG. 4 and viewed in the direction of the arrows.
Figure 3:
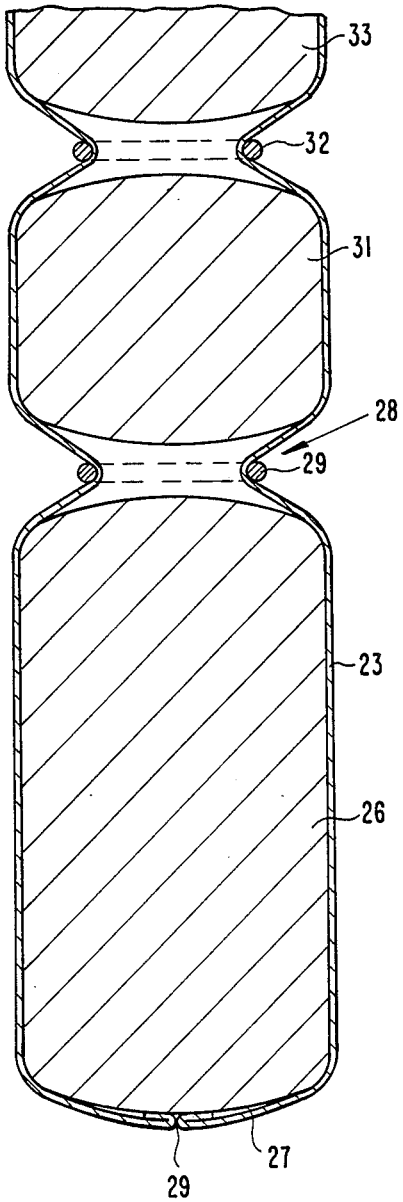
FIG. 3 is a fragmentary section through one of the tubes showing interior construction details.

As described above, after stitching the longitudinal edge portions of the strip 23 together, which provides the seam 25, the end is stitched together. It will be observed that, where the filler blocks are circular as shown in FIG. 5, some cutting of the end of the material, before stitching together, is desirable so that there may be at least four neat appearing seams such as 39 (FIG. 3) in a cross configuration at the bottom, and which are virtually undiscernible when the material is turned inside out and the bottom block 26 is installed. Similarly, although the seam 25 is shown located at one face of the screen for ease of illustration, it is preferable that it be located at the side so that it faces an adjoining column. Therefore, even though the seam may be unnoticable in the material being used for the tube, it is further obscured by being immediately adjacent the next successive column in the series. Also, as is apparent in FIG. 1, the successive columns in a series may have the constrictions alternately spaced for a particular desired decorative effect, using the shorter filler blocks such as 31 at appropriate locations.

Figure 4:
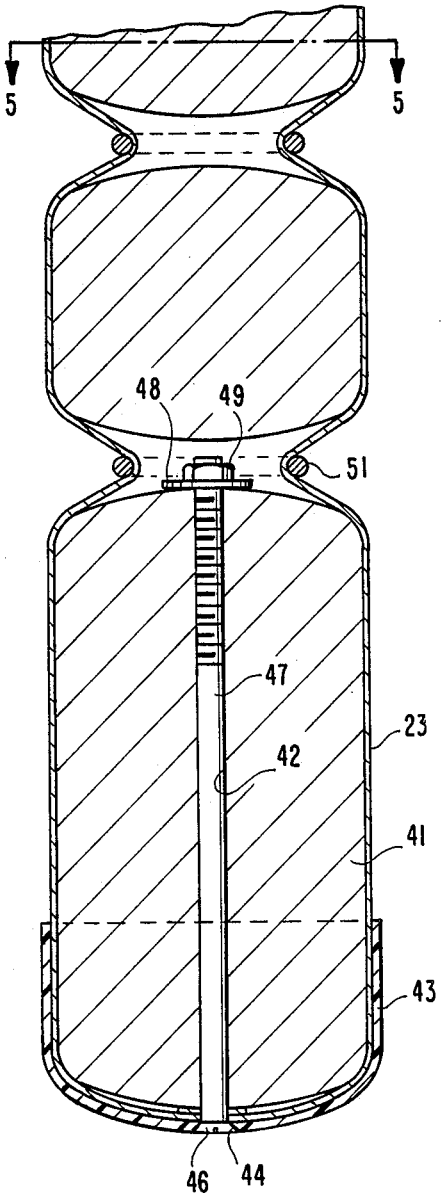
FIG. 4 is a view similar to FIG. 3 but showing the detail where a protective durable cup is secured to the bottom of the column.

FIG. 4 shows a variation where it is desired to provide a protective cup at the bottom of the screen. In this example, the filler block 41 has a centrally located longitudinally extending aperture 42 therein. A cup 43 of metal or other durable and decorative material has a central aperture 44 therein receiving the head 46 of a flathead screw 47 extending up through the block 41 and out the upper end thereof. A flat washer 48 is mounted on top of the block and a nut 49 is secured to the screw. The installation of this cup can be done immediately after the installation of the block 41 and before the mounting of the garter 51. It is done by inserting the screw through the cup and through the block 41. The washer and nut are dropped through the open upper end of the tube onto the top of block 41. Since the block 41 snugly fits the tube material 23, there is no chance that the washer or nut will slide down to the bottom. Instead, they can be located on the nut manually, because the fabric, being flexible, permits feeling them and positioning them on the screw, whereupon the nut can be held by the fingers gripping it through the fabric as the screw is turned from the bottom with the screwdriver. Then the garter ring is installed and the rest of the blocks and rings are installed and the column is attached to the hanger bar.

From the foregoing description, it should be recognized that the invention can be made using a variety of materials. Fabric has been mentioned. Velvet is a good example. Leather or decorative vinyls might also be used. The filler blocks may be wood but are more likely to be of a lightweight plastic. A good quality foamed plastic can be used. It is intended that the filler block, whether it be circular in cross section as shown in FIG. 5, or of some other cross sectional shape, be sufficiently rigid that it maintain that shape when installed in the tube. It is also intended that where the filler block is elongated, its longitudinal axis remain straight at all times. In other words, the block itself is to be rigid enough so as not to be bent. The flexibility of the screen is provided by the spaced constrictions along the length of each of the columns, and not within any section where the filler is located. While the columns may be made virtually any length, and the cross sectional dimension can have various sizes and shapes, a typical size for the columns having circular cross section is an overall diameter of less than 2.5 inches, with the constrictions in such an example having a diameter of less than 1.75 inches, the objective being to have a combination of suitable flexibility at the constrictions consistent with a pleasing esthetic effect.

The screen is particularly useful in openings between building interior rooms. With selection of suitable materials adapted to environment and desired decorative effect, the screen may be used in exterior doorways, in window openings and other locations.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A flexible screen comprising:

a series of vertically hanging columns;

each column having upper and lower end portions and comprising an elongate flexible tube containing solid filler material;

said tube being constricted at vertically spaced locations intermediate said end portions thereby facilitating the flexing of the column preferentially at said locations; and each column being hung suspended from hanger means at the upper end of the tube.

2. The screen of claim 1 wherein:

the filler material includes discrete pieces of material arranged in series in a line in the tube, adjacent pieces being spaced by the constrictions at said locations.

3. The screen of claim 2 wherein:

the pieces have shape and composition such that they are substantially resistant to bending.

4. The screen of claim 3 wherein:

the pieces are elongate and have cross-sectional dimensions snugly filling the tube.

5. The screen of claim 4 wherein:

the pieces are made of a rigid plastic foam material.

6. The screen of claim 1 and further comprising:

constrictors around the tubes at said locations.

7. The screen of claim 6 wherein:

the constrictors are decorative rings.

8. The screen of claim 6 wherein:

the filler material includes discrete pieces of material arranged in series and having shape such that each piece fills the unconstricted cross-sectional envelope of the tube.

9. The screen of claim 8 wherein:

at least some of said pieces are of composition such as to be resistant to deformation of said pieces.

10. The screen of claim 9 wherein:

said pieces are made of rigid plastic foam material.

11. The screen of claim 1 wherein:

said tube is fabric.

12. The screen of claim 11 wherein:

said tube is of circular cross section and the fabric is sewn cloth, and rings of smaller diameter than the tube are mounted on the outside of the tube at said locations.

13. A flexible screen comprising:

an elongate hanger having a series of columns hanging from said hanger;

said columns having upper and lower end portions and being attached to said hanger at spaced points along the length of the hanger;

each column having an elongate flexible tube containing solid filler material;

said tube being constricted at vertically spaced locations intermediate said end portions thereby facilitating the flexing of the column preferentially at said locations.

14. The screen of claim 13 wherein:

upper end portions of said tubes are flattened, with the flattened portions directly attached to the hanger.

15. The screen of claim 14 wherein:

said flattened ends of successive columns in the series are attached to said hanger immediately adjacent the flattened ends of the next preceding columns in the series.

16. The screen of claim 15 wherein:

the constrictions in adjacent tubes are staggered vertically.

17. The screen of claim 13 and further comprising:

constrictors at said locations;

the filler material including a piece at the bottom of the tube and having a fastener therein;

a cup at the bottom of the tube and attached to said fastener, with the tube bottom being sandwiched between the bottom piece and the cup, whereby the cup protects the bottom of the tube.

18. The screen of claim 17 wherein:

said cups are circular and have a diameter less than 2.5 inches, and said constrictions have diameters less than 1.75 inches.

19. The combination comprising:

a building wall opening including a header at the top and jambs at the side;

a screen hanger attached to the header across the top of the opening;

and a screen closing the opening and including a series of columns hanging from the hanger and having upper and lower end portions;

each of said columns comprising a flexible tube containing solid filler blocks, with each tube being constricted at vertically spaced locations intermediate said end portions.

20. The combination of claim 19 wherein:

the constrictions are established by rings around the tubes.

* * * * *